US007484614B2

(12) United States Patent
Aulanko et al.

(10) Patent No.: US 7,484,614 B2
(45) Date of Patent: Feb. 3, 2009

(54) PALLET ARRANGEMENT

(75) Inventors: Esko Aulanko, Kerava (FI); Marc Ossendorf, Bochum (DE); Jorma Mustalahti, Hyvinkää (FI)

(73) Assignee: Kone Corporation, Helsinki (FI)

( * ) Notice: Subject to any disclaimer, the term of this patent is extended or adjusted under 35 U.S.C. 154(b) by 170 days.

(21) Appl. No.: 11/416,384

(22) Filed: May 3, 2006

(65) Prior Publication Data

US 2007/0012224 A1 Jan. 18, 2007

Related U.S. Application Data

(63) Continuation of application No. PCT/FI04/000645, filed on Nov. 1, 2004.

(30) Foreign Application Priority Data

Nov. 3, 2003 (FI) ..... 20031591
Jan. 22, 2004 (FI) ..... 20040089

(51) Int. Cl.
*B66B 21/10* (2006.01)

(52) U.S. Cl. ..... 198/321; 198/502.1

(58) Field of Classification Search ..... 198/321, 198/333, 502.1
See application file for complete search history.

(56) References Cited

U.S. PATENT DOCUMENTS 4,756,398 A 7/1988 Watanabe et al.
5,042,641 A * 8/1991 Soldat ..... 198/496
5,176,239 A 1/1993 Findlay et al.
5,337,879 A * 8/1994 Fischer ..... 198/333
5,411,127 A * 5/1995 Findlay ..... 198/333
5,441,140 A * 8/1995 Reid ..... 198/333
5,685,412 A * 11/1997 Findlay et al. ..... 198/502.1
5,697,487 A * 12/1997 Engelke et al. ..... 198/333

FOREIGN PATENT DOCUMENTS

| | | |
|---|---|---|
| EP | 0 771 756 A2 | 5/1997 |
| EP | 0808792 A2 | 11/1997 |
| JP | 5-162963 | 6/1993 |
| JP | 05201681 | 8/1993 |
| JP | 2001072366 | 3/2001 |
| JP | 2001261276 | 9/2001 |
| JP | 2001316064 | 11/2001 |
| WO | WO 0066476 A1 | 11/2000 |

* cited by examiner

*Primary Examiner*—Mark A Deuble
(74) *Attorney, Agent, or Firm*—Venable LLP; Robert Kinberg; Steven J. Schwarz

(57) ABSTRACT

A pallet arrangement for a people mover includes a pallet adapted to move on wheels and form part of a moving track. The pallet includes a pallet body having at least two profile sections joined together. A wear surface is coupled to the pallet body and the two profile sections have a form-lock coupling.

13 Claims, 3 Drawing Sheets

PALLET ARRANGEMENT

CROSS-REFERENCE TO RELATED APPLICATIONS

This application is a continuation of International Application No. PCT/FI2004/000645, filed Nov. 1, 2004, designating the United States and claiming priority from Finnish Application No. FI20040089, filed Jan. 22, 2004 and Finnish Application No. FI20031591, filed Nov. 3, 2003. The disclosure of the foregoing applications is incorporated herein by reference.

BACKGROUND OF THE INVENTION

The present invention relates to a pallet arrangement for a travelator or equivalent in which a pallet moving on wheels forms a part of a moving track, the pallet consisting of at least a pallet body composed of at least two profile sections joined together, and a wear surface.

Like escalators, travelators are conveying devices designed to move people or goods. They differ from escalators, for example, in that they often work in a substantially horizontal position or in a slightly inclined position relative to their direction of motion so that successive steps, i.e. pallets, form a substantially even and rectilinear track instead of stair-like steps as in escalators. Travelators are also referred to as moving sidewalks and autowalks.

In prior-art travelators, autoramps and escalators, and equivalents, referred to herein collectively as people movers, the pallets are typically made from aluminum or other suitable metal or alloy pressure-molded as a single piece. A problem with these constructions is that the pressure-molding tools applicable for this purpose are very expensive. A further problem is that separate expensive tools are needed for each step or pallet type and for each width.

In addition, prior-art pallet constructions have, for example, plastic comb strips or equivalent used as decorative or warning elements. A problem with these solutions is that mounting the comb strips is a difficult and time-consuming operation because in known constructions they are generally fastened by means of screws to the routed edges of the steps or pallets.

SUMMARY OF THE INVENTION

An object of the present invention is to overcome the above-mentioned drawbacks and achieve an easily variable pallet structure of economical cost for use in a people mover, a pallet structure that will also allow safety-improving solutions and various visual functions, such as the presentation of information or advertisements, and that also allows fast and economical maintenance of the pallets because the surfacing part is easily replaceable and additionally permits the replacement of worn parts only, making it unnecessary to replace the entire pallet due to wear of the surfacing.

The above and other objects are accomplished according to the invention by the provision of an exemplary embodiment of a pallet arrangement for a people mover, comprising: a pallet adapted to move on wheels and form part of a moving track, the pallet comprising a pallet body including at least two profile sections joined together and a wear surface coupled to the pallet body, the two profile sections having a form-lock coupling.

The advantages of the pallet arrangement of the invention include low manufacturing costs and small investments on tools, and therefore the pallets, which may be cut in suitable lengths from extruded long profiles, can be easily and quickly replaced with a structure of a different type or shape when necessary. A further advantage is easy variability of the width of the body parts of the pallets, because the body parts of the pallets may be assembled from at least two profiles fastened together by a form-locked coupling.

It is preferable to implement the form-locked coupling between the body sections by using a separate locking piece or shaft, although for example, a snap-on coupling of the body sections or a coupling whereby the body sections are slid between the shapes of each other is also applicable as a form-locked coupling. The use of a locking piece or equivalent is preferable because such a solution is easier to make openable as the locking piece is implemented as a detachable part. The locking piece or shaft suitably constitutes part of, for example, the fastening of a wheel of the pallet or part of a fastening element by which the pallet is connected to an endless chain or equivalent serving to move the pallets.

Another advantage is that the invention allows a sufficient pallet width using extruded profiles. The number of pallets, wheels and coupling elements, etc. are reduced, which makes the structure simpler and cheaper. A further advantage is an easily variable surface structure consisting of different surfacing parts.

An additional advantage is improved user safety, because the light effects indicating the end of the track can be easily implemented so that they are better visible than in know devices, and the gaps between steps or pallets can be sealed better than in the past.

Yet another advantage is that the surface of the pallets can be used better than before as a display surface for information or advertisements.

Another advantage is that maintenance of the equipment becomes easier and cheaper because only the surface parts subject to wear need to be replaced.

An additional advantage is that the surface parts are fastened to the body of the step or pallet by form-locked snap-on couplings or equivalents that can be easily released and locked, allowing the joints to be easily uncoupled using a suitable tool.

BRIEF DESCRIPTION OF THE DRAWINGS

In the following, the invention will be described in detail with reference to an exemplary embodiment and the attached drawing.

DETAILED DESCRIPTION OF AN EXEMPLARY EMBODIMENT

Referring to the Figures, the pallet structure 1 of the invention comprises a pallet body 3, which is preferably made by extruding a suitable profile from aluminum or some other appropriate metal or alloy. In the manufacture of the profile, a certain type of profile is extruded in bars of a length well suited for manufacture, transportation or other purposes. From these profiled bars, parts having a length exactly appropriate for the purpose are subsequently cut during manufacture of the pallet. Thus, the same profile can be easily used for pallets of different lengths, so the width of the moving track of the people mover can be easily varied. Wheels 4 are fastened to the pallet body 3 at each end of the pallet. A fastening element, not shown, which may be mounted on a locking shaft, is fastened to at least one end of the pallet by which the pallet 1 is coupled to an endless chain, cogged belt, rope or equivalent actuating device serving to move the pallets.

A surface part extruded from plastic or corresponding material, and preferably comprising one or more surface plates 2*a*-2*c* of suitable width that also contain the required corrugations in the direction of the track of motion of the pallets, is fastened onto the body 3 of the pallet 1 by, for example, snap-on couplings or similar form-locked couplings. Each surface plate 2*a*-2*c* is provided with snap-on coupling elements or similar coupling elements 19, preferably placed in the lower part or lower surface of the surface plates at suitable points, for example, at the ends and the middle part of the surface plates. The surface plates thus remain firmly in place on the body 3 of the pallet. Further, the surface plates can be easily pressed into position and likewise easily released from the body by a tool appropriate for the purpose. Correspondingly, counterparts corresponding to the above-mentioned coupling elements 19 are placed at suitable points substantially in the upper part of the body 3 of the pallet for fastening to the coupling elements 19 by a form-locked coupling.

The width of the surface plates 2*a*-2*c* is so defined that, using a suitable number of surface plates of the same width, it is possible to cover pallet bodies of different lengths, so the same parts can be used to assemble pallets of different lengths.

Figure 1:
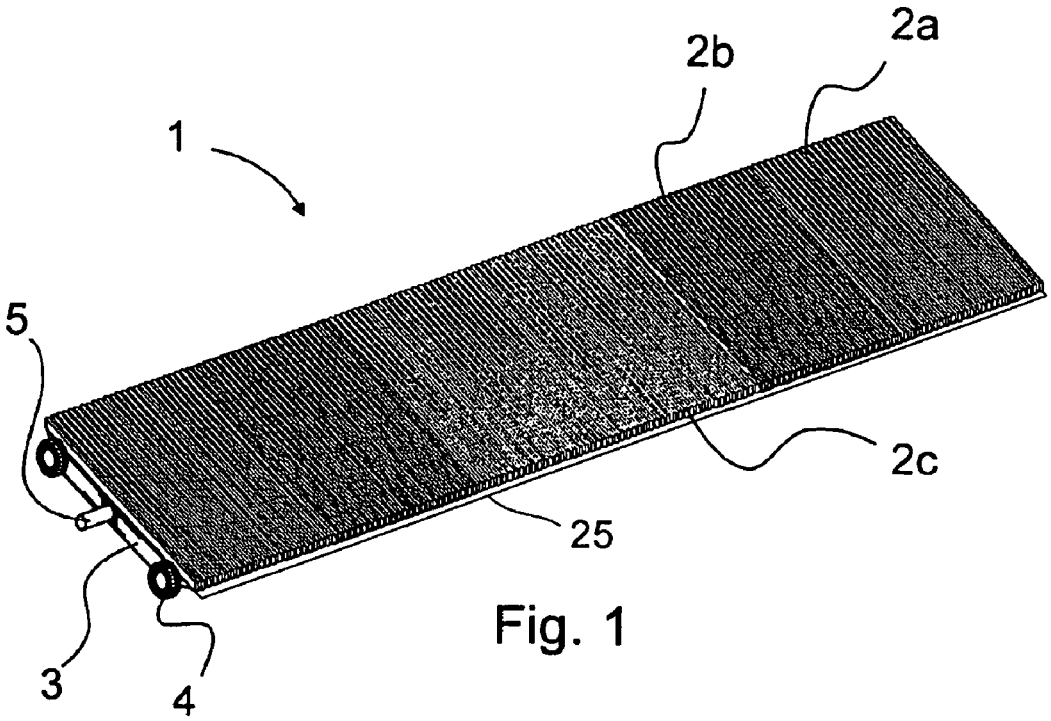
FIG. 1 presents a perspective view from the top left front side of a pallet according to an exemplary embodiment of the invention.

FIG. 1 presents a pallet 1 provided with surface plates 2*a* and 2*b* of different colors and also transparent or translucent surface plates 2*c*. Under these transparent or translucent surface plates 2*c*, and between the surface plate 2*c* and the body 3, it is possible to place, for example, a notice, advertisement or other element varying the appearance, printed on paper, plastic or similar material, which can be illuminated from below or from the side to produce different visual effects. The transparent or translucent surface plates 2*c* are preferably placed in the middle part of the pallet 1. By placing surface plates of different colors at different positions in the longitudinal direction of the pallet 1, it is possible to vary the appearance of successive pallets, allowing the appearance of the moving track of the people mover to be easily changed and given a different look.

The solution of the invention also allows the gap between successive pallets 1 in the people mover to be made considerably wider than in known devices of this type, even as much as about ten times wider, depending on the surfacing solutions. The transparent or translucent gap thus formed can be illuminated from below to warn about the danger posed by the approaching end of the moving track. The attention arousing effect of the warning light in the wide gap thus formed is very good, so that passengers concentrated on studying the notices or advertisements or equivalent can be effectively aroused to the danger caused by the approaching end of the moving track. When plastic elements are illuminated from the side, it also possible to produce impressive illumination effects as the light is scattered, for example, at the crests of the corrugations mentioned above.

Figure 2:
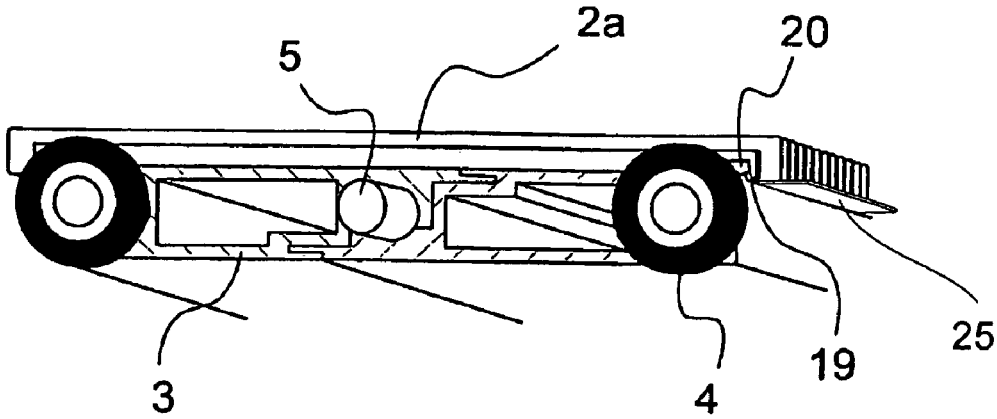
FIG. 2 presents a more detailed perspective view from the bottom left front side of the pallet shown in FIG. 1.

When required, a suitable sealing surface or some other applicable sealing structure, such as a sealing lip 25. shown in FIGS. 1 and 2, can be easily fastened to the extruded plastic surfacing part 2*a*-2*c*, to close the gap between successive pallets 1. The use of such a sealing improves the operating safety, among other things, and prevents small objects from falling down into the mechanical structures of the people mover.

The body 3 of the pallet 1 includes at least two adjacent profile sections. The body 3 is preferably composed of two body halves 6 and 7 comprised of identical profile sections, mounted in upturned positions relative to each other and in contrary orientations in the horizontal direction as well. Thus, the two halves 6 and 7 of the body can easily be cut off the same profiled bar and turned into inverse positions for joining together when the body is being assembled.

Figure 3:
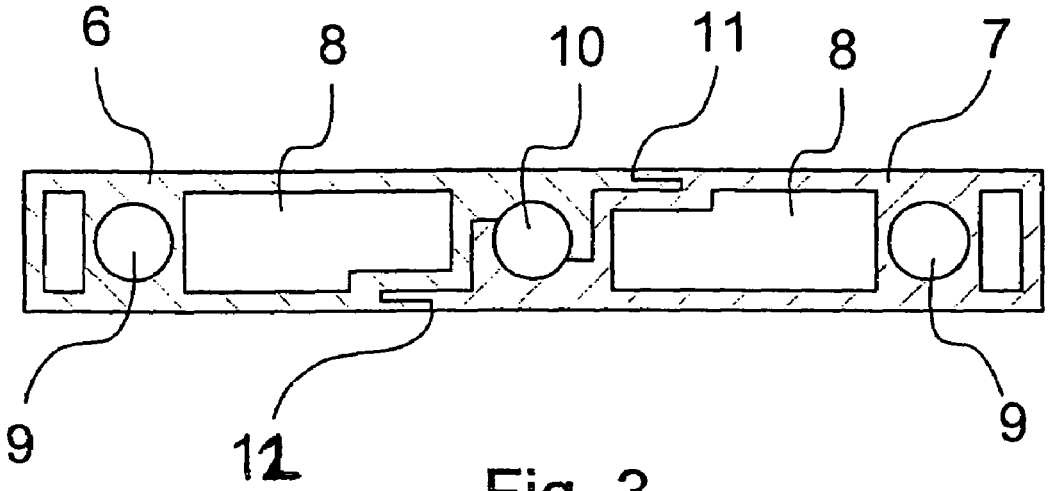
FIG. 3 illustrates the body structure of the pallet according to an exemplary embodiment of the invention as seen from an end of the pallet.
Figure 4:
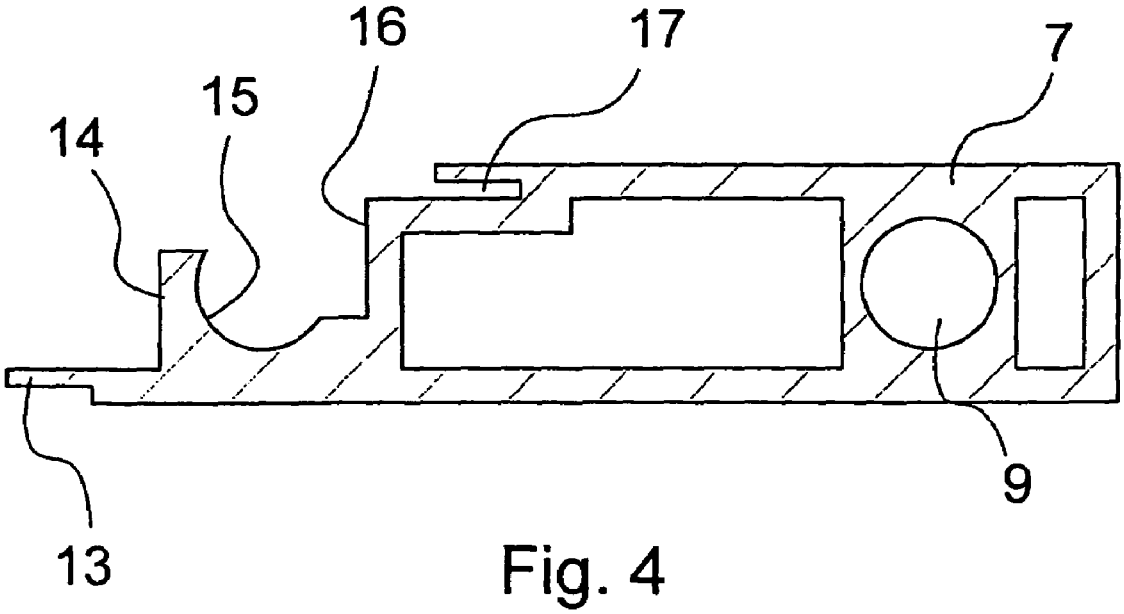
FIG. 4 shows a half of the body structure illustrated in FIG. 3.

FIGS. 3 and 4 present a more detailed illustration of the structure of a pallet body 3 according to the invention. The body 3 is assembled from two halves 6 and 7 of identical cross-section made, for example, from an extruded profile of aluminum or similar metal. Inside each half are cavities 8 reducing the weight and also holes 9 for the axles of the wheels 4. At the middle of the body as seen from the end, the assembled body also has a hole 10 for a locking shaft 5. The hole 10 is so designed and placed that when the locking shaft 5 is in the hole 10, the body halves 6 and 7 are locked together by a form-locked coupling. When the body halves 6 and 7 are joined together, seams 11 and 12 extending in the longitudinal direction of the body remain visible between the halves, one on each side of the body.

FIG. 4 shows a cross-section of one of the identical body halves 7 in end view. The outer edge of the profile may be straight, but the inner edge, which is to be placed against the other body half 6, has a profile shape that makes it possible to lock the halves together by the locking element 5 so that locking results in a joint as firm as possible. The inner edge comprises a projection 13 extending horizontally, i.e. parallel to the lower surface of the profile, at a short distance from the lower edge towards the opposite half, after which the inner edge rises upwards at right angles to the lower surface, reaching a level above the center in the vertical direction between the upper and lower surfaces of the profile and forming a surface 14 perpendicular to the lower surface. After this, the inner edge continues through a short horizontal distance, after which the inner surface goes downwards, passing in the form of a circular arch through a distance corresponding to a semi-arch 15 so that the first end of the arch, i.e. the end closer to the opposite half, is higher than the second end of the arch. In addition, the ends of the arch are located at equal distances from the vertical center of the profile, the first end above the center and the second end below it. After this, the inner edge extends horizontally through some distance towards the outer edge of the profile and then turns perpendicularly upwards, forming a surface 16 perpendicular to the lower surface. Before joining the upper surface of the profile, the inner edge forms a recess 17 corresponding in size and position to the projection 13 at the lower edge.

When the body halves 6 and 7 are placed opposite to each other and pushed into engagement with each other in an interlocked manner, the projection 13 of the first half 7 goes into the recess 17 of the second half 7, surfaces 14 and 16 are placed as mating surfaces against each other and the semiarchs 15 combine to form a full circle to define hole 10. The two halves 6 and 7 are locked together by means of a knuckle pin 5. In addition, it is possible to apply glue or equivalent to the joint surfaces to produce a stronger joint.

Figure 5:
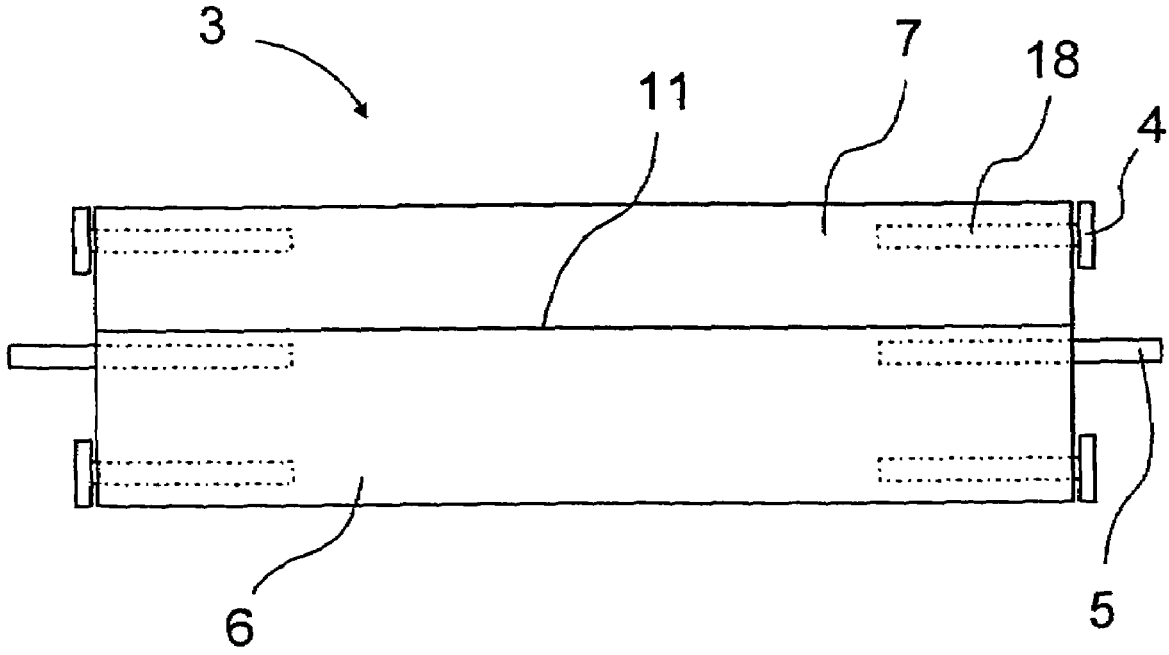
FIG. 5 shows a top view of the body of a pallet with wheels according to an exemplary embodiment of the invention.

FIG. 5 shows a top view of the body 3 of the pallet. During assembly, as stated above, the two halves 6 and 7 are joined together by their inner edges and locked together by the locking shafts 5. In addition, the structure is provided with wheels 4 by inserting the axles 18 of the wheels into the holes 9 near the outer edges of the profile structure.

It is obvious to the person skilled in the art that the invention is not limited to the example described above, but that it may be varied within the scope of the claims presented below. Thus, the material and method of manufacture of the pallet body may differ from the above description. Likewise, the pallet body may consist of more than two adjacent sections. In this case, too, it would be preferable to make the sections identical so that the body could be assembled by cutting pieces of a suitable length from only one type of profiled bar. However, the profile sections need not necessarily be identical. Only the mating surfaces have to match each other so as to allow the sections to be well joined together.

It is likewise obvious that instead of two locking shafts 5 the structure may have only one long locking shaft. In this latter case, a fastening element may be placed at one end by which the pallet 1 is coupled to an endless actuating device serving to move the pallets as stated above. The outer end of the locking shaft 5 may also remain inside the pallet body, in which case the above-mentioned fastening element can be placed in the same hole 10 with the locking shaft.

In addition, the size, shape, structure and material of the surface plates of the pallets may differ from the above description. Thus, for example, the surface plates may be made from material other than plastic. Likewise, not all the above-mentioned elements need necessarily be used on one pallet. A pallet may be provided with only one kind of surface plates, and so on.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A pallet arrangement for a people mover, comprising:

a pallet adapted to move on wheels and form part of a moving track, the pallet comprising a pallet body including at least two profile sections joined together and a wear surface coupled to the pallet body, the two profile sections having a form-lock coupling, wherein the form-lock coupling includes a locking shaft.

2. The pallet arrangement according to claim 1, wherein the form-lock coupling includes a locking piece.

3. The pallet arrangement according to claim 1, wherein the at least two profile sections comprise pieces cut to a predetermined size from a profiled bar.

4. The pallet arrangement according to claim 1, wherein the profile body comprises a piece of material cut to a predetermined size, and consisting of two substantially identical profile sections set against each other.

5. The pallet arrangement according to claim 4, wherein the piece of material comprises extruded aluminum.

6. The pallet arrangement according to claim 1, wherein the profiles have mating surfaces shaped so that when set against each other, the profile sections are lockable together by a form-lock coupling in the form of a locking shaft.

7. The pallet arrangement according to claim 1, wherein the wear surface is comprised of surface plates of substantially equal size extruded from plastic or a material corresponding to plastic.

8. The pallet arrangement according to claim 7, wherein each surface plate has a lower part including a coupling element and the pallet body has an upper part including counterparts to which the coupling elements are fastenable by a form-lock coupling.

9. The pallet arrangement according to claim 7, wherein the surface plates are of mutually different colors.

10. The pallet arrangement according to claim 7, wherein at least one of the surface plates is translucent or transparent.

11. The pallet arrangement according to claim 10, further including a notice, advertisement or other element varying the appearance and printed on paper, plastic or equivalent located between the at least one translucent or transparent surface plate and the pallet body.

12. The pallet arrangement according to claim 11, further including illumination equipment under the translucent or transparent surface plates and fitted to illuminate from below the notice, advertisement or other element varying the appearance.

13. The pallet arrangement according to claim 7, further including a seal fastened to an edge of the surface plates to seal a gap between successive pallets.

* * * * *